US007488191B2

(12) United States Patent
Nakase et al.

(10) Patent No.: US 7,488,191 B2
(45) Date of Patent: Feb. 10, 2009

(54) SLIDE SWITCH PREVENTING A SPRING FROM EJECTION

(75) Inventors: Yusho Nakase, Yokohama (JP); Yong-Hui Hu, Shenzhen (CN); Tai-Ping Xiong, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/789,372

(22) Filed: Apr. 24, 2007

(65) Prior Publication Data

US 2007/0249198 A1 Oct. 25, 2007

(30) Foreign Application Priority Data

Apr. 24, 2006 (TW) ..... 95206947 U

(51) Int. Cl.
*H01R 13/62* (2006.01)
*H01H 1/36* (2006.01)

(52) U.S. Cl. ..... 439/157; 200/536

(58) Field of Classification Search ..... 439/157, 439/159, 160; 200/16 C, 16 R, 16 D, 516, 200/531, 314
See application file for complete search history.

(56) References Cited

U.S. PATENT DOCUMENTS 3,614,347 A * 10/1971 Castle ..... 200/16 D
3,673,365 A * 6/1972 Schadow ..... 200/16 R
3,800,107 A * 3/1974 Heide ..... 200/16 D
3,914,570 A * 10/1975 Lockard ..... 200/524
4,000,383 A * 12/1976 Lockard ..... 200/16 D
2005/0224327 A1* 10/2005 Agnatovech et al. ..... 200/314
2007/0278084 A1* 12/2007 Kawamura et al. ..... 200/531
2008/0073195 A1* 3/2008 Nakase et al. ..... 200/536

* cited by examiner

*Primary Examiner*—Chandrika Prasad
(74) *Attorney, Agent, or Firm*—Wei Te Chung

(57) ABSTRACT

A slide switch (100) includes a housing (1), a plurality of stationary contacts (2) embedded in the housing, a slide member (4) moveably contained in the housing, and a cover (6) attached to the housing. The housing includes a bottom surface (10) and a plurality of side surfaces (11) therearound, and said bottom surface and side surfaces cooperatively defines a cavity. The slide member includes a containing portion (42) and an operating portion (41). A coil spring (5) is sandwiched between one end of the containing portion and corresponding side surface of the housing, and the moveable contact (3) is attached to the containing portion. The containing portion includes a rib (421) at an upper portion of an opposite end thereof for abutting against opposite side surface of the housing, and the rib is higher than the spring in vertical direction.

12 Claims, 4 Drawing Sheets

SLIDE SWITCH PREVENTING A SPRING FROM EJECTION

BACKGROUND OF THE INVENTION

1. Field of the Invention

The present invention relates to a slide switch for use in various electronic devices such as portable telephones and digital cameras.

2. General Background

Nowdays, slide switches of the so-called auto return type are widely used in various electronic devices such as portable telephones and digital cameras. The slide switches of this type are usually operable for changing a sound volume level or a zooming level, for example, and they return to a neutral position when the operation stops. Such a conventional switch will be described below.

The conventional slide switch generally comprises an insulative housing, a plurality of stationary contacts fixed in the housing, a slide member moveable mounted onto the housing, and a cover covering the housing and the slide member.

The housing has a substantially longitudinal configuration with a top opening, and the housing comprises a bottom surface and a plurality of side surfaces around said bottom surfaces. Said bottom surface and side surfaces cooperatively define a cavity for accommodating the slide member. The stationary contacts are embedded in the bottom surface of the housing. The slide member comprises a containing portion recessed in the bottom surface substantially in the center thereof and an operating portion extending from the housing. A moveable contact is fixed to the slide member for connecting to or disconnecting from the stationary contacts. A coil spring is defined for attaching to the slide member.

In assembly, the moveable contact is fixed to the slide member and the coil spring attaches to the slide member. Then the slide element is mounted into the cavity of the housing from the top opening. The containing portion is received in the cavity and the operating portion extends out of the cavity from a cut out of the lateral side surface. At this time, the coil spring is slightly pre-compressed between the containing portion and corresponding side surface of the housing. The cover subsequently covers the housing and the slide member for preventing EMI.

In use, the slide switch is mounted onto a printed circuit board, and the stationary contacts connect with corresponding circuits of the printed circuit board. At this time, the moveable contact contacts with some predetermined stationary contacts. When the operating portion is actuated from the neutral position to the pressed position, the coil spring is compressed, and the moveable contact contacts with some other predetermined stationary contacts in the bottom surface. When the operating portion is released, the slide member will auto return to the neutral position under the pressure of the coil spring.

However, one problem with this conventional slide switch is that the coil spring is prone to be ejected from the predetermined position or even from the cavity of the housing when the slide element is sharply pressed by the released spring to return to the neutral position. Therefore, reliable mechanical performance of the slide switch can not be ensured.

In view of the above, a new slide switch which overcomes the above-mentioned disadvantages is desired.

SUMMARY

Accordingly, an object of the present invention is to provide a slide switch that can prevent the spring being ejected from predetermined position, therefore ensuring reliable mechanical performance of the slide switch.

According to a preferred embodiment of the invention, a slide switch in accordance with a preferred embodiment of the present invention comprises a housing, a plurality of stationary contacts embedded in the housing, a slide member moveably contained in the housing, and a cover attached to the housing. The housing comprises a bottom surface and a plurality of side surfaces therearound, and said bottom surface and side surfaces cooperatively define a cavity. A moveable contact is fixed to said slide member and arranged to be connected to and disconnected from said stationary contacts. A coil spring is defined between the slide member and corresponding side surfaces of the housing. The slide member defines a rib at an upper portion of an opposite end without spring for abutting against corresponding opposite side surface. Therefore, when the slide member auto returns to the neutral position, the upper rib will abut against the side surface. The counterforce applied to the rib by the side surface forms torsion towards the cavity of the housing, and the slide member presses the spring in the cavity of the housing tightly. Therefore, the coil spring will not be ejected from the housing, and reliable mechanical performance of the switch is achieved.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Figure 1:
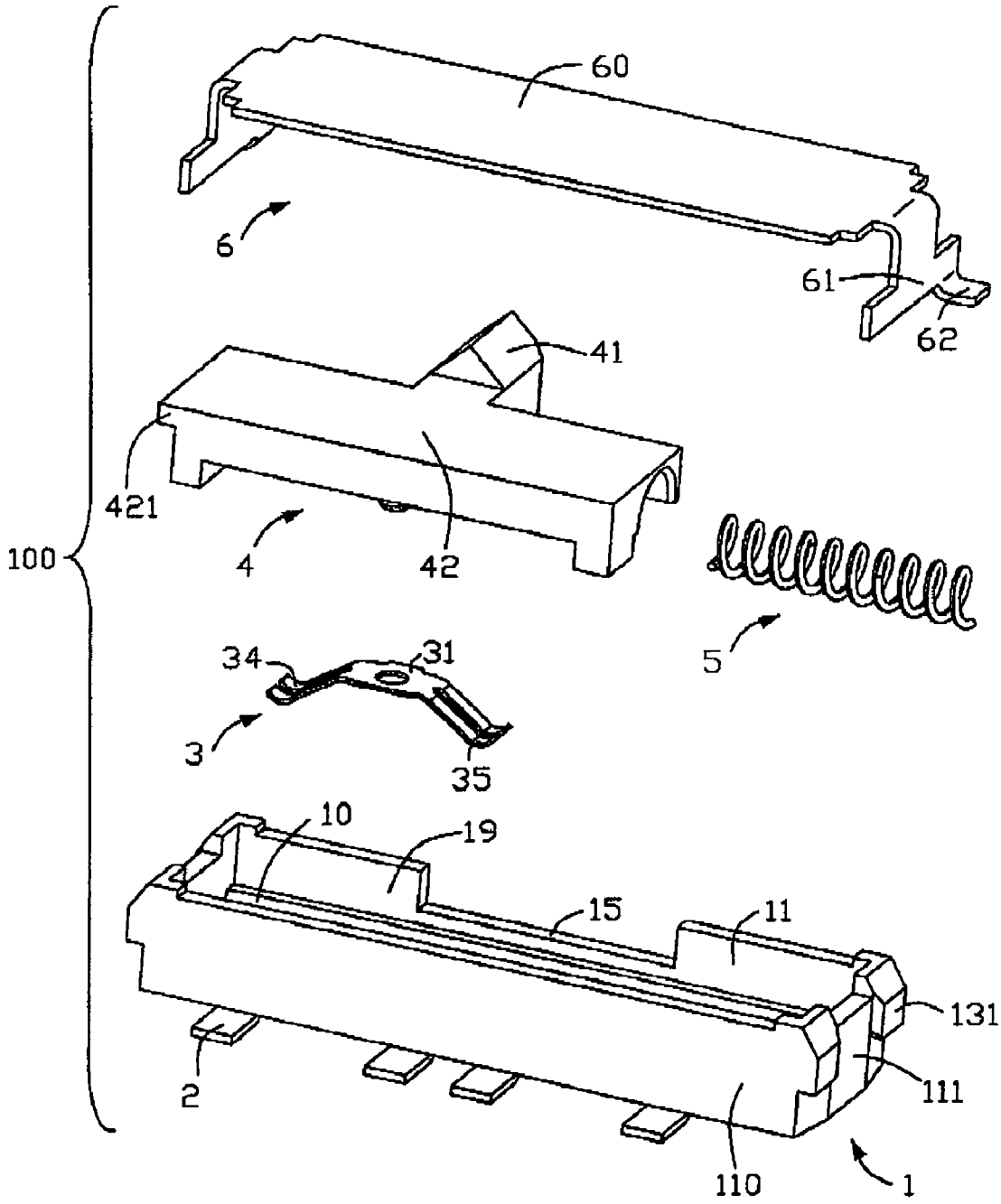
FIG. 1 is an exploded, isometric view of a slide switch in accordance with the preferred embodiment of the present invention.

Reference will now be made to the drawings to describe the present invention in detail.

Referring to FIGS. 1-4, a slide switch 100 in accordance with the preferred embodiment of the present invention comprises a housing 1 with a bottom surface 10 and a plurality of side surfaces 11 around the bottom surface, a plurality of stationary contacts 2 embedded in the bottom surface of the housing 1, a slide member 4 moveably contained in the housing, and a cover 6 attached to the housing 1. A moveable contact 3 is fixed to said slide member 4 and arranged to be connected to and disconnected from said stationary contacts 2. An urging spring, such as a coil spring 5 is formed between the slide member 4 and corresponding side surfaces of the housing 1.

The housing 1 has a longitudinal configuration. The bottom surface 10 and the side surface 11 with two longitudinal side surfaces 110 and two lateral side surfaces 111 cooperatively define a cavity 19 with a top opening. One of the longitudinal side surfaces 110 defines a cut out 15 substantially at the middle thereof. Each end of the housing 1 defines a pair of protrusions 131 at upper portions of two sides, and therefore a gap is formed between said two protrusions 131. The stationary contacts 2 are embedded in the bottom surface along the longitudinal direction.

Figure 2:
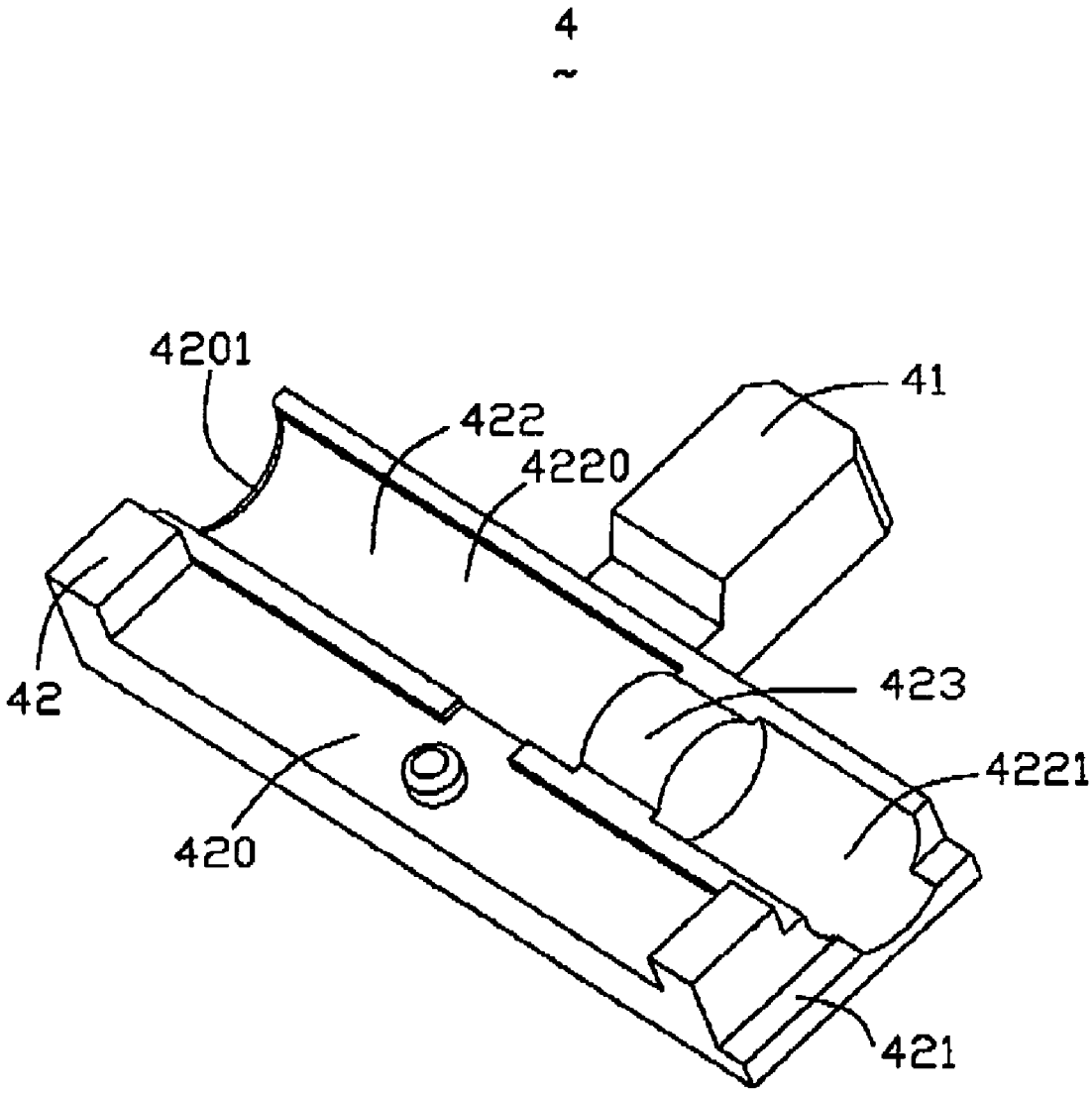
FIG. 2 is an inverted isometric view of the slide member of the slide switch in FIG. 1.
Figure 3:
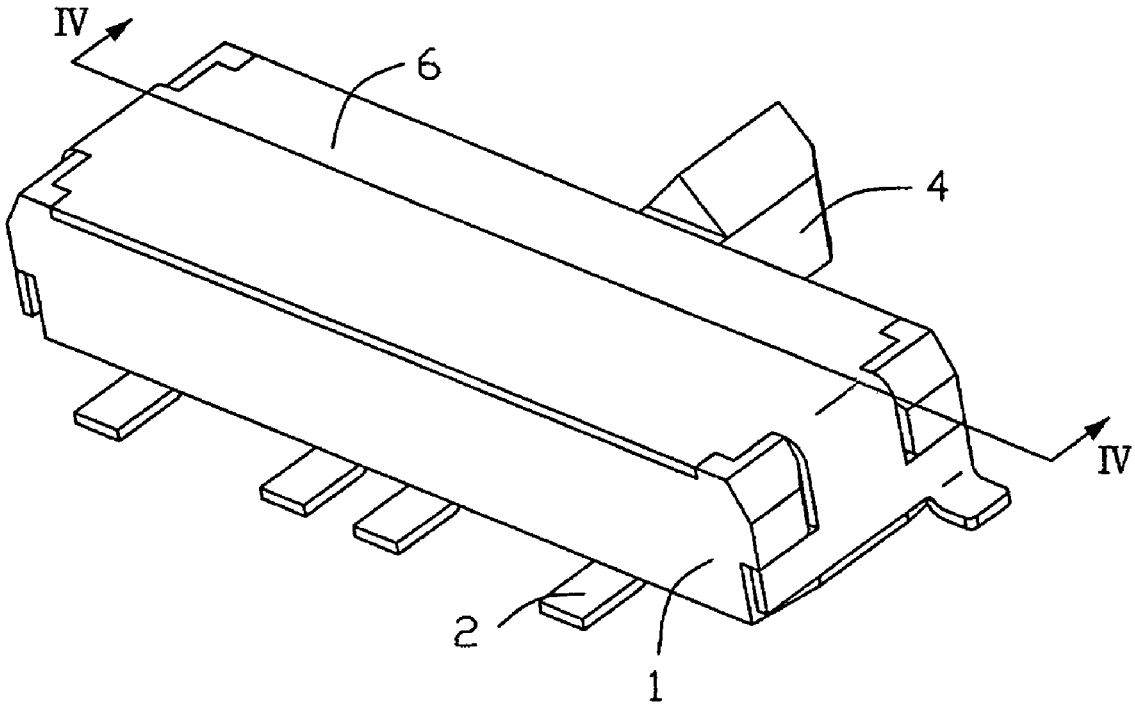
FIG. 3 is an isometric view of the assembled slide switch of FIG. 1.
Figure 4:
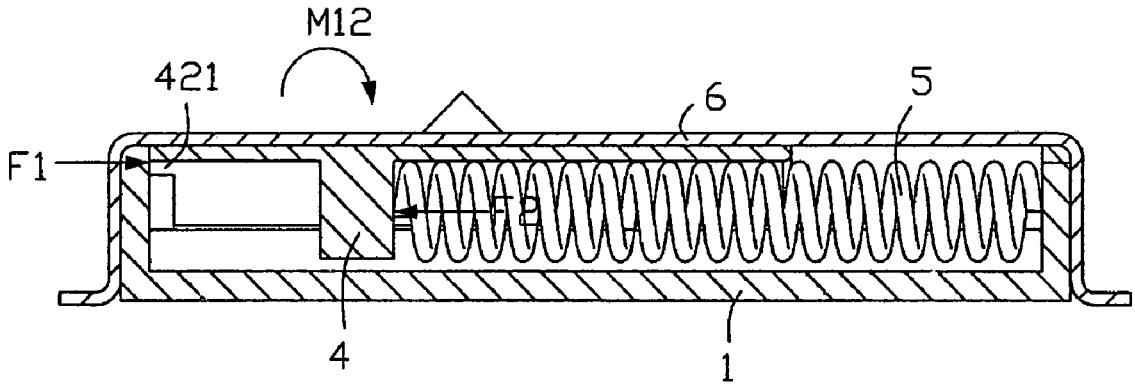
FIG. 4 is a cross-sectional view taken along line IV-IV of FIG. 3, showing how the slide member pressing the coil spring in the housing tightly.

The slide member 4 comprises an operating portion 41 and a containing portion 42 accommodated in the cavity substantially in the center thereof. The operating portion 41 laterally extends from a middle portion of one outer longitudinal sidewall of the containing portion 42, As shown in FIG. 1. As shown in FIG. 2, the containing portion 42 defines two parallel Recesses, a second recess 420 and a first recess, 422 in a lower surface thereof along the longitudinal direction thereof. The first recess 422 is adjacent to the operating portion 41 and is separated into two portions 4220, 4221 by a substantially cylindrical block 423. The two portions 4220, 4221 of the first recess 420 run trough the two opposite ends of the containing portion 42. The coil spring 5 is partly accommodated in one portion 4220 of the first recess 422. One end of the spring 5 slightly abuts against the block 423, and another opposite end of the spring 5 extends beyond the corresponding end 4201 i.e. the first end of the containing portion 42. The moveable contact 3 is fixed to the second recess 420. The moveable contact 3 is slightly bent and comprises a center fixing portion 31 and two contacting portions 34, 35 at both ends thereof. The moveable contact 3 can move wit the slide member 4 for connecting to or disconnecting from the stationary contacts 2. The containing portion 42 further defines a rib 421 parallel extending from an second end opposite to said first end 4201 thereof, the rib is at an upper portion of the containing portion and a top surface of the rib 421 is flush with the top surface of the containing portion 42.

The cover 6 comprises a longitudinal main body 60 and a pair of narrower retaining portion 61 extending from two ends of the main body 60. The retaining portion 61 has an inverted "T" shaped configuration, and a soldering tail 62 extends from lower end of the retaining portion 61.

In assembly, the moveable contact 3 is fixed to the second recess 420 of the containing portion via the center fixing portion 31, and the coil spring 5 is partly accommodated in the first recess 422, with one end abutting against the block 423 and another end extending beyond the first end of the containing portion 420. Then the slide element 4 is mounted into the housing from the top opening, with the containing portion 42 received in the cavity 19 and the operating portion 41 extending out the housing from the cut out 15 of the longitudinal side 110. At this time, another end of the spring 5 abuts against a corresponding lateral side surface 111 of the housing 1, therefore the coil spring 5 is slightly pre-compressed between the block 423 and said the lateral side surface 111. The rib 421 also abuts against another lateral side surface under the pressure of the spring 5. The cover 6 subsequently mounts onto the housing 1, and the main body 60 covers the slide member 4 and the retaining portion 61 engages with protrusions 131 of the housing 1.

In use, the slide switch 100 is mounted onto a printed circuit board (not shown), and the stationary contacts 2 connect wit corresponding circuits of the printed circuit board. At this time, the moveable contact 3 contacts with some predetermined stationary contacts 2. When the operating portion 41 is actuated from the neutral position to the pressed position, the coil spring 5 is compressed, and the moveable contact 3 contacts with some other predetermined stationary contacts 2 in the bottom surface 10. When the operating portion 41 is released, the slide member 4 will auto return to the neutral position under the restoring pressure of the coil spring 5. Because the rib 421 horizontally protrudes from the end of the containing portion 42, the rib 421 will abut against corresponding side surface. The side surface inversely presses the rib 421 and forms torsion M12 towards the cavity of the housing 1, i.e. the torsion M12 apply a downward tilting tendency to the containing portion 42, which moves the coiling spring toward the bottom surface. The torsion M12 makes the containing portion 42 of the slide member 4 to press the coil spring 5 inwardly, therefore the coil spring will not be ejected from the housing, and reliable mechanical performance of the slide switch is achieved.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. A slide switch comprising:

a housing comprising a bottom surface and a plurality of side surfaces therearound, said bottom surface and side surfaces cooperatively defining a cavity;

a plurality of stationary contacts embedded in the bottom surface of to housing;

a slide member comprising a containing portion and an operating portion, the containing portion moveably mounted in the cavity, the containing portion comprising a first recess in a lower surface thereof along a longitudinal direction, a coil spring accommodated in the first recess with one end of the spring abutting against a block defined in the first recess and another end of the spring extending beyond a first end of the containing portion for abutting against a corresponding side surface of the housing, a moveable contact being retained in the low surface of the containing portion parallel to the first recess;

a cover attached to the housing and the slide member;

wherein the containing portion comprises a rib extending from a second end opposite to said first end of the containing portion thereof for abutting against a corresponding side surface of the housing.

2. The slide switch as claimed in claim 1, wherein the rib is at an upper portion of said second end of the containing portion.

3. The slide switch as claimed in claim 2, wherein the rib comprises a top surface being flush with top surface of the containing portion.

4. The slide switch as claimed in claim 1, wherein the lower surface of the containing portion defining a second recess parallel to the first recess to retain the moveable contact.

5. The slide switch as claimed in claim 4, wherein the first recess is nearer to the operating portion than the second recess.

6. A slide switch comprising:

a housing comprising a bottom surface and a plurality of side surfaces therearound, said bottom surface and side surfaces cooperatively defining a cavity;

a plurality of stationary contacts embedded in at least one of said surfaces of the housing;

a slide member comprising a containing portion and an operating portion, the containing portion moveably mounted into the cavity, an urging spring being sandwiched between one end of the containing portion and corresponding side surface of the housing, a moveable contact attached to the containing portion for connecting to or disconnecting from the stationary contacts;

a cover attached to the housing and the slide member;

wherein the containing portion and the corresponding side surface engages each other, due to the urging spring, at a position where a downward tilting tendency is applied to the containing portion to move the urging spring toward the bottom surface.

7. The slide switch as claimed in claim 6, wherein at least one of the containing portion and the corresponding side surface forms a rib thereon.

8. The slide switch as claimed in claim 7, wherein the rib is located close to the cover while relatively far from the bottom surface

9. The slide switch as claimed in claim 6, wherein said position is located close to the cover while relatively far from the bottom surface.

10. A slide switch comprising:

a housing comprising a bottom surface and a plurality of side surfaces therearound, said bottom surface and side surfaces cooperatively defining a cavity;

at least one stationary contacts embedded in one of said surfaces of the housing;

a slide member comprising an operating portion extending out the cavity and a containing portion moveably in the cavity actuated by the operation, a coil spring being pit-pressed between the containing portion and a corresponding first side surface of the housing, a moveable contact attached to the containing portion for connecting to or disconnecting from the stationary contacts;

a cover attached to the housing and the slide member;

wherein the containing portion defining a rib abutting against a second side surface opposite to said first side surface of the housing due to the coil spring.

11. The slide switch as claimed in claim 10, wherein the containing portion comprises a recess in a lower surface thereof, the coil spring is accommodated in the recess with one end of the spring abutting against a block defined in the recess and another end of the coil spring extending beyond the containing portion for abutting against the first side surface of the housing.

12. The slide switch as claimed in claim 10, wherein the rib is at an upper portion of the containing portion.

* * * * *